US010614930B2

(12) United States Patent
Angermann et al.

(10) Patent No.: US 10,614,930 B2
(45) Date of Patent: Apr. 7, 2020

(54) INDUCTION CABLE, COUPLING DEVICE, AND METHOD FOR PRODUCING AN INDUCTION CABLE

(71) Applicant: LEONI KABEL HOLDING GMBH, Nuremberg (DE)

(72) Inventors: Gerhard Angermann, Georgensgmuend (DE); Klaus Bitterwolf, Spalt (DE); Thomas Brunner, Schwabach (DE); Michael Dreiner, Wipperfuerth (DE); Christian Eck, Wipperfuerth (DE); Jan Foerster, Wipperfuerth (DE); Sebastian Goss, Roth (DE); Jens Mosebach, Wipperfuerth (DE); Ulrich Raupach, Bamberg (DE); Rainer Sessner, Roth (DE)

(73) Assignee: LEONI Kabel Holding GmbH, Nuremberg (DE)

( * ) Notice: Subject to any disclaimer, the term of this patent is extended or adjusted under 35 U.S.C. 154(b) by 799 days.

(21) Appl. No.: 15/250,268

(22) Filed: Aug. 29, 2016

(65) Prior Publication Data

US 2017/0004902 A1 Jan. 5, 2017

Related U.S. Application Data

(63) Continuation of application No. PCT/EP2015/054181, filed on Feb. 27, 2015.

(30) Foreign Application Priority Data

Feb. 28, 2014 (DE) ..... 10 2014 203 773

(51) Int. Cl.
*H01B 7/00* (2006.01)
*H05B 6/10* (2006.01)
(Continued)

(52) U.S. Cl.
CPC ..... *H01B 7/009* (2013.01); *H01B 3/12* (2013.01); *H01B 7/0208* (2013.01);
(Continued)

(58) Field of Classification Search
CPC ... E21B 43/2401; H01B 13/0036; H01B 3/12; H01B 7/009; H01B 7/0208; H01R 11/32;
(Continued)

(56) References Cited

U.S. PATENT DOCUMENTS 3,457,540 A * 7/1969 Rolfes ..... F24H 1/105 439/193
8,766,146 B2 * 7/2014 Diehl ..... E21B 36/04 219/600
(Continued)

FOREIGN PATENT DOCUMENTS

DE 889178 C 9/1953
DE 102009042127 A1 3/2011
(Continued)

*Primary Examiner* — Dana Ross
*Assistant Examiner* — Joseph W Iskra
(74) *Attorney, Agent, or Firm* — Laurence A. Greenberg; Werner H. Stemer; Ralph E. Locher

(57) ABSTRACT

An induction cable contains a plurality of cable conductors each having a conductor strand surrounded by insulation. The conductor strand contains a plurality of conductor sections which are spaced apart in the longitudinal cable direction at resonance dividing points by insulating intermediate pieces. The induction cable furthermore has a coupling device on which a plurality of the conductor strands are separated forming coupling ends at coupling positions. The coupling ends are connected to each other via the coupling device. A simple providing and installing of the induction cable and a simple replacement of damaged cable parts is thus enabled.

18 Claims, 4 Drawing Sheets

(51) Int. Cl.

| | |
|---|---|
| ***H01B 3/12*** | (2006.01) |
| ***H01B 7/02*** | (2006.01) |
| ***H01B 13/00*** | (2006.01) |
| ***H01R 11/32*** | (2006.01) |
| ***H01R 24/28*** | (2011.01) |
| ***E21B 43/24*** | (2006.01) |

(52) U.S. Cl.
CPC ..... *H01B 13/0036* (2013.01); *H01R 11/32* (2013.01); *H01R 24/28* (2013.01); *H05B 6/108* (2013.01); *E21B 43/2401* (2013.01); *H05B 2214/03* (2013.01)

(58) Field of Classification Search
CPC .... H01R 24/28; H05B 2214/03; H05B 6/108; H01L 37/009; H01L 37/0208
USPC ..... 219/600, 607, 603, 629, 611, 614–617, 219/674, 161, 488, 544, 672; 174/110; 166/245, 248, 50, 60, 302, 369, 272.1, 166/271.3; 392/301; 29/857
See application file for complete search history.

(56) References Cited

U.S. PATENT DOCUMENTS

| | | | | |
|---|---|---|---|---|
| 2006/0000634 | A1* | 1/2006 | Arakawa | F21S 8/06 174/128.1 |
| 2012/0181858 | A1 | 7/2012 | Hellinger | |
| 2014/0263289 | A1* | 9/2014 | Mosebach | E21B 43/2401 219/672 |

FOREIGN PATENT DOCUMENTS

| | | | |
|---|---|---|---|
| EP | 2250858 | B1 | 8/2011 |
| WO | 2013079201 | A1 | 6/2013 |

* cited by examiner

INDUCTION CABLE, COUPLING DEVICE, AND METHOD FOR PRODUCING AN INDUCTION CABLE

CROSS-REFERENCE TO RELATED APPLICATION

This is a continuation application, under 35 U.S.C. § 120, of copending international application No. PCT/EP2015/054181, filed Feb. 27, 2015, which designated the United States; this application also claims the priority, under 35 U.S.C. § 119, of German patent application No. DE 10 2014 203 773.5, filed Feb. 28, 2014; the prior applications are herewith incorporated by reference in their entirety.

BACKGROUND OF THE INVENTION

Field of the Invention

The invention relates to an induction cable containing a plurality of cable cores which each have a conductor strand which is surrounded by insulation. The conductor strand contains a plurality of conductor sections which are spaced apart by respectively insulating intermediate regions with at least one insulating intermediate piece at resonance separation points in a cable longitudinal direction. The invention further relates to a coupling device for an induction cable of this kind, and also to a method for producing an induction cable of this kind.

An induction cable of this kind, also called an inductor, serves to form one or more so-called induction fields. In this case, the induction cable is provided, in particular, for inductively heating oil sand and/or ultra-heavy oil deposits. An application of this kind for an induction cable of this kind can be found, for example, in European patent EP 2 250 858 B1, corresponding to U.S. Pat. No. 8,766,146. The technical boundary conditions resulting from this application are met by the induction cable.

In order to build up the induction fields and implement inductive heating, it is necessary for the individual cable cores of the cable to be separated at defined separation points into contact spacing with a defined length of, for example, several tens of meters. In the process, each of the cable cores is subdivided by the separation points into a number of core sections.

Within the cable, a plurality of cable cores is preferably combined to form core groups, wherein the separation points or interruptions of the cores of a respective core group are situated substantially at the same longitudinal position. There are typically two core groups, the separation points of the core groups being shifted by half the contact spacing relative to one another. In other words: the separation points of a first core group are arranged at half the distance between two separation points of a second core group in the longitudinal direction. As a result, the core sections of different groups overlap, this serving, in particular, to form an induction cable.

A cable of this kind is described, for example, in international patent disclosure WO 2013 079 201 A1, corresponding to U.S. patent publication No. 2014/0263289. This document discloses a cable core for a cable, in particular for an induction cable, containing a plurality of cable cores of this kind which each have a conductor which is surrounded by insulation. Furthermore, the respective cable core, that is to say a conductor which is surrounded by an insulation sheath, is interrupted at prespecified longitudinal positions at separation points in the cable longitudinal direction so as to form two core ends. In order to connect the core ends, a connector containing an insulating intermediate piece is provided and the core ends are fastened to the connector on both sides of the intermediate piece. In order to connect the core ends, the connector is of sleeve-like design at its opposite end sides, so that a respective core end, that is to say also a portion of the insulation sheath in particular, is surrounded.

Induction cables of this kind are usually drawn into the induction field in prepared pipes. The length of a respective induction cable is from several hundred meters to kilometers in this case.

In this case, an induction cable of this kind is typically made up of a plurality of core bundles which are, in particular, braided together. In this case, the overall braided composite typically has a diameter in the range of several centimeters, for example in the range of from 5 to 20 cm.

Providing and laying an encompassing induction cable of this kind is technically complicated.

SUMMARY OF THE INVENTION

Against this background, the object of the invention is to specify an improved induction cable which is easier to provide and to lay.

According to the invention, the object is achieved by an induction cable having the features of the main claim. According to the main claim, the induction cable contains a plurality of cable cores which each have a conductor strand which is surrounded by insulation and which contains a plurality of conductor sections which are spaced apart by insulating intermediate regions at resonance separation points in the cable longitudinal direction. The intermediate region is formed by at least one insulating intermediate piece, an intermediate piece of this kind is at least arranged in the intermediate region. Furthermore, a coupling device is integrated into the induction cable and at least a plurality of the conductor strands are interrupted at a coupling position and each have a pair of coupling ends which are connected to one another at the coupling position with the aid of the coupling device.

Two different variant embodiments of the coupling device are provided in principle, specifically connection of only a number of conductor strands or connection of all of the conductor strands. At least in the first-mentioned case, the coupling device has a coupling module as an additional component which is provided with receptacles for the coupling ends. A plurality of the conductor strands are jointly held on the coupling module by way of their coupling ends. In the second-mentioned case, the cable is therefore divided at the coupling point so as to form two cable ends which are connected to one another by the coupling device.

The coupling device therefore provides a unit for connecting a plurality of the conductor strands, for example half of the conductor strands or all of the conductor strands, so that this plurality of conductor strands can be connected to one another jointly in a simple manner by the coupling device.

In general, production, provision or laying of the induction cable is simplified by the coupling device. In all cases, the induction cable specifically does not have to be produced in one piece over its entire length. Instead, it can be subdivided into individual subsections. In the case of the second-mentioned variant with the complete separation, individual partial cable pieces are therefore provided, the partial cable pieces having to be provided as such at the laying location in the induction field and having to be connected to one another only immediately during laying.

This allows simplified transportation and also simpler handling overall. Furthermore, this also makes repair simpler since only the defective partial cable piece has to be replaced if there is a defect.

In addition, quality control is simplified in both variants since, in the event of a quality deficiency, it is only necessary to replace the defective partial piece in a simple manner during production. It is also easier to check individual partial pieces than with a complete cable with a length of several hundred meters to a few kilometers.

The first-mentioned variant of the coupling device, in which only some of the conductor strands are connected by the coupling device, advantageously makes use of the fact that the individual conductor strands contains individual conductor sections which are separated from one another by the intermediate regions and have a prespecified length. Therefore, during production, the individual conductor sections can be provided as individual lengths with a defined spacing length with the aid of the coupling device and can be connected to one another by the coupling device.

For the second-mentioned case of complete separation of the induction cable at the coupling position, the coupling device has two coupling parts for combining the two cable ends. The two cable ends are received and held in these two coupling parts, and the coupling device is designed, overall, in the manner of a plug connection, screw connection or else latching connection. The two coupling parts are combined in the cable longitudinal direction during connection. The individual separated conductor strands of the induction cable are then automatically connected during this combination process.

In a preferred refinement, the coupling device is configured as a connection which can be reversibly released, so that the individual coupling ends, in particular the two cable ends, can be reversibly connected to one another by the coupling device. This allows simple disconnection, even after assembly has taken place, for example in order to replace a defective subsection.

The individual coupling ends of the individual conductor strands are preferably combined by plug connections. According to a first variant, plug connection elements are fitted to the coupling ends, for example welded, soldered, crimped or else injected-molded onto said coupling ends, for this purpose. As an alternative to this, the coupling ends are plugged into the receptacles of the coupling module or into suitable connection pieces which are situated in the receptacles. The coupling ends are preferably prepared in a suitable manner in both cases.

According to a preferred development, the coupling device is arranged at the resonance separation point, which is to say at a longitudinal position of the induction cable at which some of the conductor strands have intermediate pieces. A plurality of groups of conductor strands are preferably formed in the induction cable, in particular two groups, wherein each group has the intermediate regions at identical longitudinal positions. The conductor ends of the conductor strands, which conductor ends are opposite one another, form the coupling ends in this case. Therefore, the intermediate regions are integrated in the coupling module. The coupling module therefore has a plurality of first receptacles of a first connection type, wherein in each case at least one intermediate piece is arranged in each of the first receptacles.

In this case, the individual groups of conductor sections are usually spaced apart from one another by a defined distance which is constant over the cable longitudinal direction. When there are two groups, this distance is half the contact spacing, that is to say half the spacing between two resonance separation points.

In an expedient refinement, the coupling module contains a plurality of second receptacles of a second connection type, wherein the two coupling ends are electrically conductively connected to one another in the second receptacles. In this case, the conductor strand is therefore interrupted in the region of a respective conductor section by the coupling device and electrically conductively connected by the coupling device. A refinement with second receptacles of this kind also allows positioning of the coupling device at an axial longitudinal position at which no intermediate pieces are arranged.

In a particularly preferred refinement, it is provided that the coupling module has both first receptacles with the integrated intermediate pieces and second receptacles for electrically conductive connection. In this case, the coupling device serves for complete separation and connection of the induction cable so as to form two cable ends.

Within the conductor strand composite of the induction cable, the different groups of conductor strands are usually arranged in a manner distributed in line with a prespecified pattern, in particular in such a way that a conductor strand of one group is in each case arranged next to the conductor strand of the other group. As a result, an insulating intermediate piece is therefore usually positioned alternately next to a conductor section in the region of a resonance separation point. The individual conductor strands typically form an, in particular, multilayer conductor bundle, in particular a multi-layer braided composite. By way of example, two layers are arranged around a central strand. The first layer has, for example, six cores and the second layer has 12 cores.

With regard to connection of the coupling ends which is as simple as possible, sleeves are expediently arranged in the receptacles, the coupling ends being inserted and, in particular, plugged into the sleeves. The sleeves are selectively composed of an insulating material or of a conductive material. In the first-mentioned case, the sleeves preferably form an intermediate piece for forming a resonance separation point. The sleeves are formed, for example, as a double sleeve with an intermediate piece arranged between opposite sleeve sections. The material used for the insulating sleeve is, in particular, ceramic, in order to achieve a high level of resistance to partial discharge.

The coupling connection is expediently formed between the coupling ends or a fastening of the coupling ends in the sleeves with the aid of a profiled portion. To this end, the respective sleeve is provided, selectively or else in combination, with an at least partially profiled inner wall and/or a profiled portion is formed at the coupling ends themselves. According to a first variant embodiment, the profiled portion is configured as a pull-out protection device in this case, so that a high pull-out resistance in the axial direction is therefore formed. The profiled portions are formed, for example, in the manner of ribs which run, in particular, in a circular manner, or else in the manner of barbs. In a preferred refinement, a thread is formed by the profiled portion, so that the two parts can be screwed one into the other. In the variant embodiment with sleeves, the sleeve therefore has thread elements on its inner wall and, in a manner corresponding thereto, the coupling end which is to be inserted into the sleeves likewise has a thread element, so that the two partners can be connected to one another by being screwed one into the other.

Expediently, the coupling ends are preferably additionally each provided with a termination piece, a separate sub-element therefore being fastened to the coupling ends. In this case, said separate sub-element preferably has the profiled portion. According to a first variant, these termination pieces are, in particular, cap-like elements in the form of termination caps which are placed on the coupling end over the respective end region. The termination pieces are, in particular, welded metal caps for example. As an alternative, insulating caps are fitted, wherein the insulating caps expediently also form the insulating intermediate piece at the same time. Therefore, there is no need to form an integral continuous intermediate piece. Therefore, two insulating caps, which are separated from one another around possibly include an air gap between them, can also be arranged in the insulating intermediate region as intermediate pieces. As an alternative to the cap-like elements, cylindrical, bolt-like elements can also be arranged, in particular welded, as termination pieces.

In order to allow simple connection of the individual coupling ends, the coupling module expediently has an approximately star-shaped carrier which has a plurality of receptacles for the coupling ends. This refinement relates, in particular, to the variant embodiment in which only some of the conductor strands are coupled. The carrier has carrier arms and therefore an approximately branched structure, wherein, in particular, the first receptacles are formed on the carrier.

In the case of a carrier of this kind, in each case one receptacle is provided in the region of a resonance separation point at the positions which the individual conductor strands in the cable composite assume. Therefore, the same conductor strand pattern as is also present in the induction cable is replicated by the carrier. It is therefore ensured that the conductor strand composite is maintained and the individual conductor strands do not need to be moved from the bundle arrangement to a connection plane, for example.

The coupling module, in particular the carrier, expediently has a plurality of recesses through which—in the region of the resonance separation point—the conductor sections are guided without interruption. The conductor sections are therefore not separated.

The carrier is designed as a separate component which is formed, for example, in the manner of a thick circular disk with a branched structure. The continuous conductor sections are inserted into the recesses in a simple manner. In this case, the recesses are expediently accessible radially from the outside, that is to say are open to the outside.

In this respect, the approximately star-shaped carrier separates the two groups of conductor strands from one another and is therefore also called a separating star in the text which follows.

In this case, the coupling module, in particular the carrier, is expedeiently configured as an injection-molded part. The injection-molded part is provided as a prefabricated part to which the coupling ends are then attached and connected to one another.

In a preferred development, the induction cable has a functional line, specifically, for example, a strain-relief device, a sensor line or else a data line, which is guided by the coupling device either without interruption or so as to form two partial pieces which are connected to one another. The sensor line is, for example, a fiber-optic cable, preferably for temperature measurement. Data can be transmitted along the cable with the aid of the data line. In a preferred variant, these lines are therefore connected to one another in the manner of line connectors to one another with the aid of the coupling device. In the case of pure guidance, a recess is preferably also formed in the carrier for this functional line, so that the functional line can be laterally introduced in the radial direction.

The receptacles are expediently oriented in the direction of a connection direction which is at a prespecified angle in relation to the cable longitudinal direction. Therefore, the connections are not oriented parallel to the longitudinal direction. This refinement is based on the consideration that, in particular in the case of helically running conductor strands, for example as a result of braiding, the receptacles are preferably obliquely oriented in order to accommodate the respective direction of the conductor strands, so that the conductor strands are guided further through the receptacles over their course. The orientation of the receptacles, that is to say the connection direction of the receptacles, corresponds, in particular, to a pitch or orientation of the conductor strands in this case.

The provision of a separate component within the cable by the coupling device provides a way of integrating additional functional elements into the cable. A sensor module is preferably integrated in the coupling device. In this case, the sensor module contains at least one sensor for detecting values of parameters, selectively cable parameters, for monitoring the function of the cable or else environmental parameters for ascertaining properties of the area surrounding the cable. Particularly when detecting measurement values relating to environmental parameters, effective monitoring and checking of the area surrounding the induction cable, that is to say in particular of the entire induction field, can be achieved in a simple manner. The measurement data is expediently transmitted to an evaluation unit. To this end, the transmission is provided, in particular, by the above-mentioned data line which is integrated into the cable as a functional line.

According to the invention, the object is further achieved by a method for producing an induction cable, in which method a plurality of coupling ends are connected to one another with the aid of a coupling device.

The advantages cited in respect of the induction cable and preferred embodiments can analogously also be transferred to the method.

Two cable ends are expediently connected to one another by the coupling device, specifically preferably in such a way that the cable ends are rotated relative to one another about the cable longitudinal direction in the event of connection by the coupling device. Owing to the rotation, in particular a helical pitch of the individual conductor strands is recorded and/or tracked. This variant embodiment is provided, in particular, in combination with the receptacles which are oriented obliquely in a connection direction, so that, that is to say owing to this rotational movement, the individual cable ends or the individual coupling ends of the conductor strands are introduced into the receptacles parallel to the connection direction.

In an expedient refinement, for the purpose of producing the induction cable, the individual conductor sections are provided as individual lengths and connected to one another by the coupling device so as to form the resonance separation points. Here, connection is intended to be understood to mean that the coupling ends are held in a manner separated from one another by an insulating intermediate piece. The coupling device contains, for example, a ceramic element as an intermediate piece for this purpose. Therefore, partial cable core pieces, in particular with the prespecified spacing or resonance length, are provided between two resonance separation points and connected to one another by the coupling device at the resonance separation points. The above-described separating star in particular is provided for this purpose.

Other features which are considered as characteristic for the invention are set forth in the appended claims.

Although the invention is illustrated and described herein as embodied in a induction cable, a coupling device, and a method for producing an induction cable, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In the figures, similarly acting parts are provided with the same reference symbols.

Figure 1:
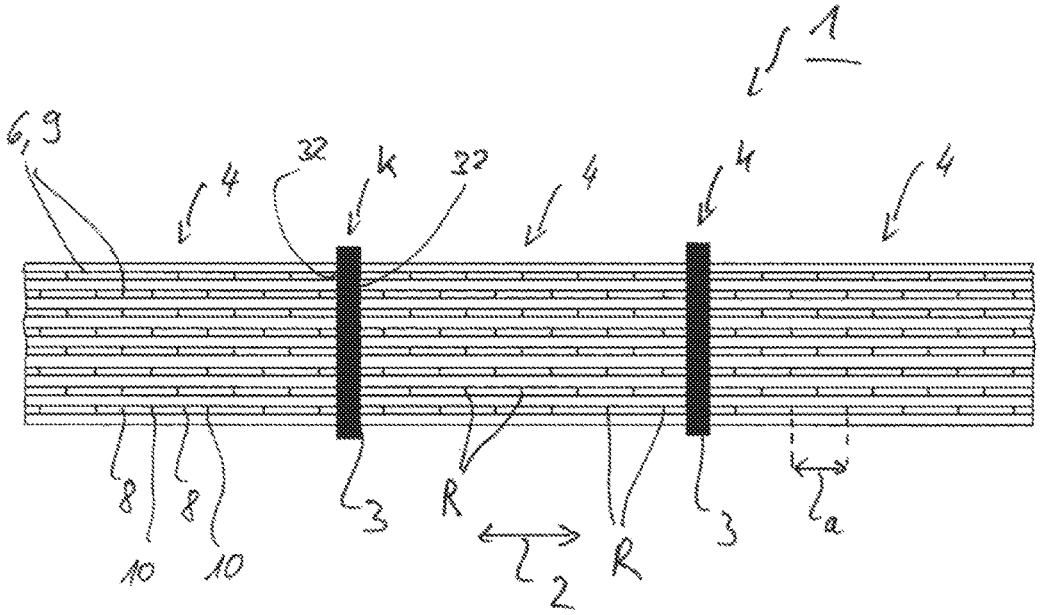
FIG. 1 is a symbolic, side view of an induction cable according to the invention.

Referring now to the figures of the drawings in detail and first, particularly to FIG. 1 thereof, there is shown an induction cable 1 extending in a cable longitudinal direction 2 and has, in the exemplary embodiment, a plurality of coupling devices 3 at which individual partial cable pieces 4 are coupled to one another. The induction cable 1 usually has a large number of cable cores 6. In this case, each individual cable core 6 is formed by a plurality of conductor sections 8 which are spaced apart from one another in the cable longitudinal direction 2 by insulating intermediate pieces 10. The conductor sections 8 together with the insulating intermediate pieces 10 form a conductor strand 9 which is sheathed by an insulation 11 (compare, in particular, FIG. 6 in this respect) in order to form the cable core 6. The insulation 11 is selectively a taping or else an, in particular extruded, insulation sheath. The intermediate pieces 10 are composed of a suitable insulation material, in particular of ceramic.

In this case, the conductor sections 8 have a contact spacing "a" typically in the region of several tens of meters, for example in the region of 50 m or a multiple thereof. The overall length of an induction cable 1 of this kind is usually several hundreds of meters, in particular in the region of a few kilometers, for example in the range of from 1 to 3 km. Induction cables 1 of this kind are laid in the ground in order to inductively heat oil sands. The induction cables are usually introduced into pipes for this purpose. The coupling devices 3 are at a distance of greater than the contact spacing "a", in particular a multiple of the contact spacing "a", in relation to one another.

At the same time, the intermediate pieces 10 define resonance separation points R which are arranged in the contact spacing "a". The resonance separation points R of the various cable cores 6 are located at different longitudinal positions, wherein a plurality of the cable cores 6 are preferably combined to form groups, of which the resonance separation points R are located at an identical longitudinal position. In the exemplary embodiment, two groups of cable cores 6 are formed, the resonance separation points R of the groups being offset in relation to one another by half a contact spacing "a".

In contrast, a respective coupling device 3 defines a coupling position K at which, therefore, a plurality of cable cores 6 are interrupted and connected by the coupling device 3. Here, interrupted is intended to be understood to mean that the cable core 6 or the conductor strand 9 is not guided further without interruption, but rather is separated so as to form coupling ends 20*a, b* (compare, for example, FIGS. 3 and 6 in this respect). The individual cable cores 6 typically have a diameter in the range of from, for example, 1.5 to 2.5 mm, wherein the conductor strand 9 has a diameter of typically 0.8 to 1.5 mm.

Figure 2:
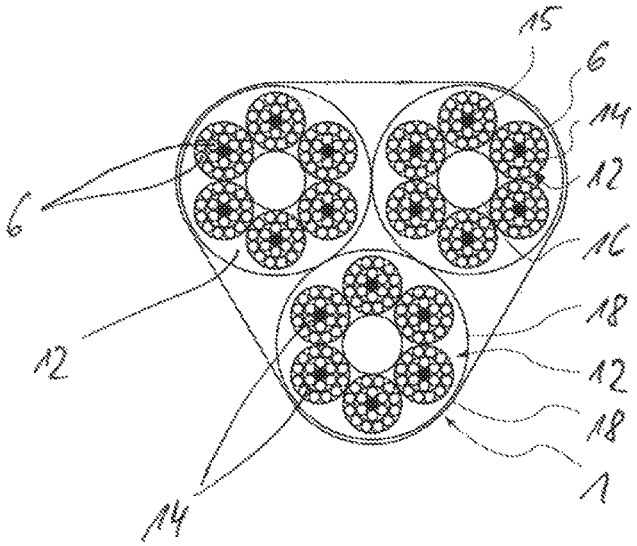
FIG. 2 is a cross-sectional view of the induction cable having a plurality of component cables.

A preferred construction of an induction cable 1 of this kind is illustrated in FIG. 2. According to FIG. 2, the overall induction cable 1 is made up of a plurality of component cables 12, wherein each component cable 12 in turn has a plurality of core bundles 14 which each have a strain-relief device 16 in the center. The individual core bundles 14 are a composite, in particular a braided composite, of a plurality of cable cores 6 which, in turn, are arranged around a central strand, in particular an optical waveguide 15. In the exemplary embodiment, the core bundles 14 are braided in two layers around the optical waveguide 15. Overall, six of these core bundles 14 are then arranged, in particular braided, around the strain-relief device 16 of the component cable 12 and form the component cable 12. The component cable 12 preferably has a cable sheath 18. The three component cables 12 are, in turn, usually braided with one another and likewise surrounded by a further cable sheath 18.

Figure 3:
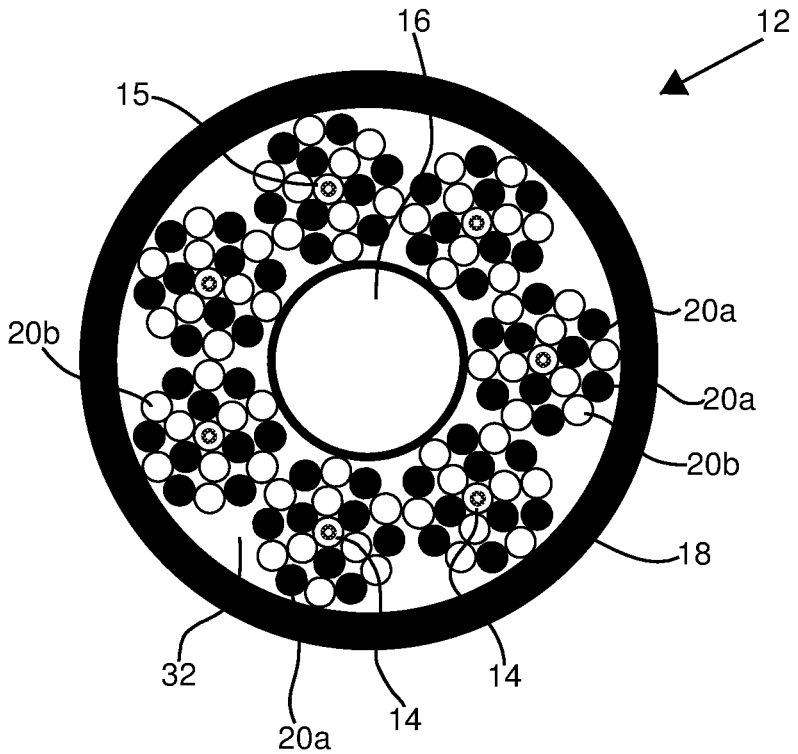
FIG. 3 is a cross-sectional view of a component cable.

FIG. 3 shows a cross section through one of the component cables 12 with the core bundle 14 braided around the strain-relief device 16. In each of the core bundles 14, the individual cable cores 16 are arranged, in particular braided, around the central optical waveguide 15. In this case, FIG. 3 shows a section through the induction cable 1 at one of the resonance separation points R. The dark circles mark first coupling ends 20*a* in the region of the resonance separation point R, that is to say in the region of the insulating intermediate pieces 10, whereas the light circles show second coupling ends 20*b* of the conductor sections 8 which are of continuous design or are then electrically contact-connected to one another by the coupling device 3.

Figure 4:
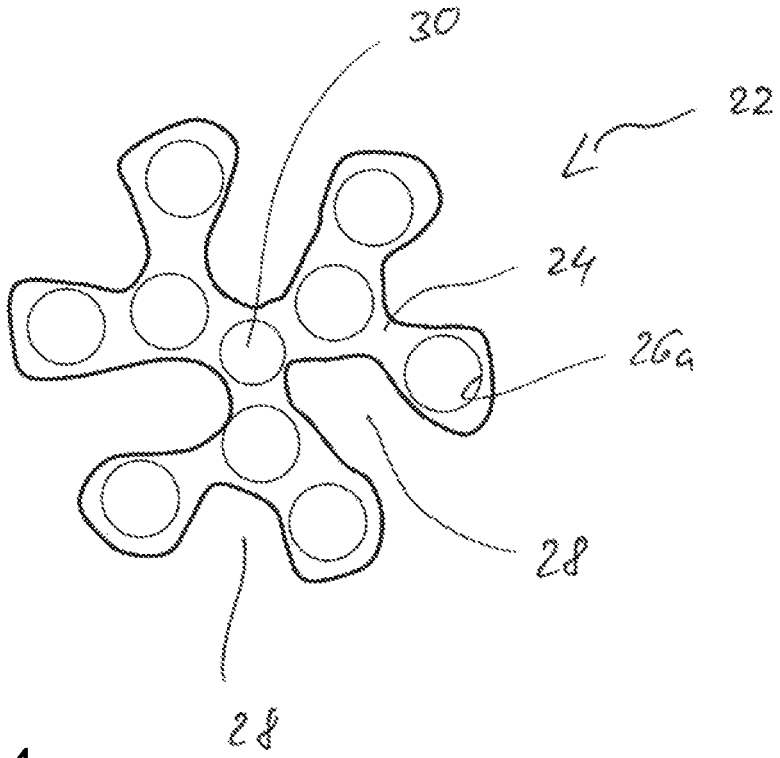
FIG. 4 is a plan view of a carrier, which is configured as a separator star, of a coupling module.

FIG. 4 illustrates a first variant embodiment of a coupling module 22 which is designed as a separator star. The coupling module contains an approximately star-shaped carrier 24 which has, corresponding to the positions of the first coupling ends 20*a*, first receptacles 26*a* in the form of passage holes which form first connections. The carrier 24 therefore has arms in which these first receptacles 26*a* are made in the manner of passage bores. Recesses 28, which are open radially to the outside, are formed between these arms. The continuous conductor sections 8 which are guided without interruption are inserted into these recesses 28 from the outside. In contrast, the first receptacles 26*a* define the resonance separation point R with the insulating intermediate piece 10.

Furthermore, a functional connection 30 is formed centrally in the carrier 24, the functional connection being configured to guide and, in particular, to connect a central functional conductor, specifically the optical waveguide 15. This functional connection 30 is configured, for example, in the manner of a plug connector for connecting two light guide ends or receives corresponding plug connection elements.

Figure 5:
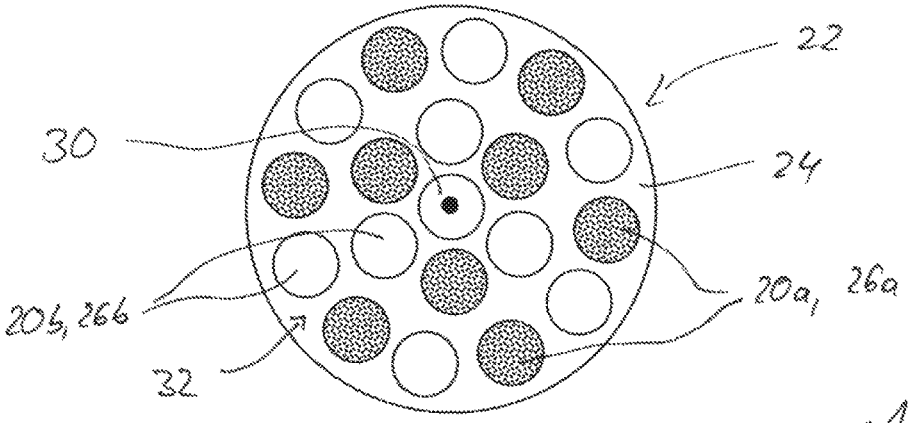
FIG. 5 is a cross-sectional view of a further variant embodiment of the carrier of a coupling module.

Whereas only a limited number of cable cores 6 are interrupted in the case of the separator star according to FIG. 4, all of the cable cores 6 of the core bundle 14 are interrupted and connected to one another by the coupling module 22 in the case of coupling module 22, as is illustrated in FIG. 5. In FIG. 5, the dark circles once again indicate the first coupling ends 20*a* of the electrically conductively guided conductor sections 8 and the light circles once again indicate the second coupling ends 20*b* at the resonance separation point R. In this respect, FIG. 5 therefore shows a cable end 32 within the meaning of the present application. Here, the light circles at the same time also define second receptacles 26*b* in which the coupling ends 20*b* are situated. These second receptacles 26*b* are, in turn, formed by bushings through the carrier 24. The carrier 24 is generally composed of an insulating material, in particular plastic, and is configured, for example, in an approximately plate-like or disk-like manner with only a small thickness in the cable longitudinal direction 2.

In the present case, "cable" is generally intended to be understood to mean any common composite of cable cores 6, in particular a braided composite. Therefore, the core bundle 14 forms a smallest cable unit. The next largest medium cable unit is formed by the component cable 12, and the next largest cable unit in turn is finally formed by the entire induction cable 2.

The different refinements of the coupling device 3 described here selectively relate to the smallest cable unit (core bundle 14), the medium cable unit (component cable 12) or the overall cable unit (inductor cable 2). The described construction of the coupling device 3 therefore serves selectively to connect the core bundle 14, the component cable 12 or else the entire induction cable 1.

A dedicated coupling device 3 is expediently provided for each component cable 12, so that each component cable 12 can be independently separated. As an alternative, an overall coupling device 3 is also provided, it being possible for the induction cable 1 to be separated overall at a separation point by the overall coupling device.

Figure 6:
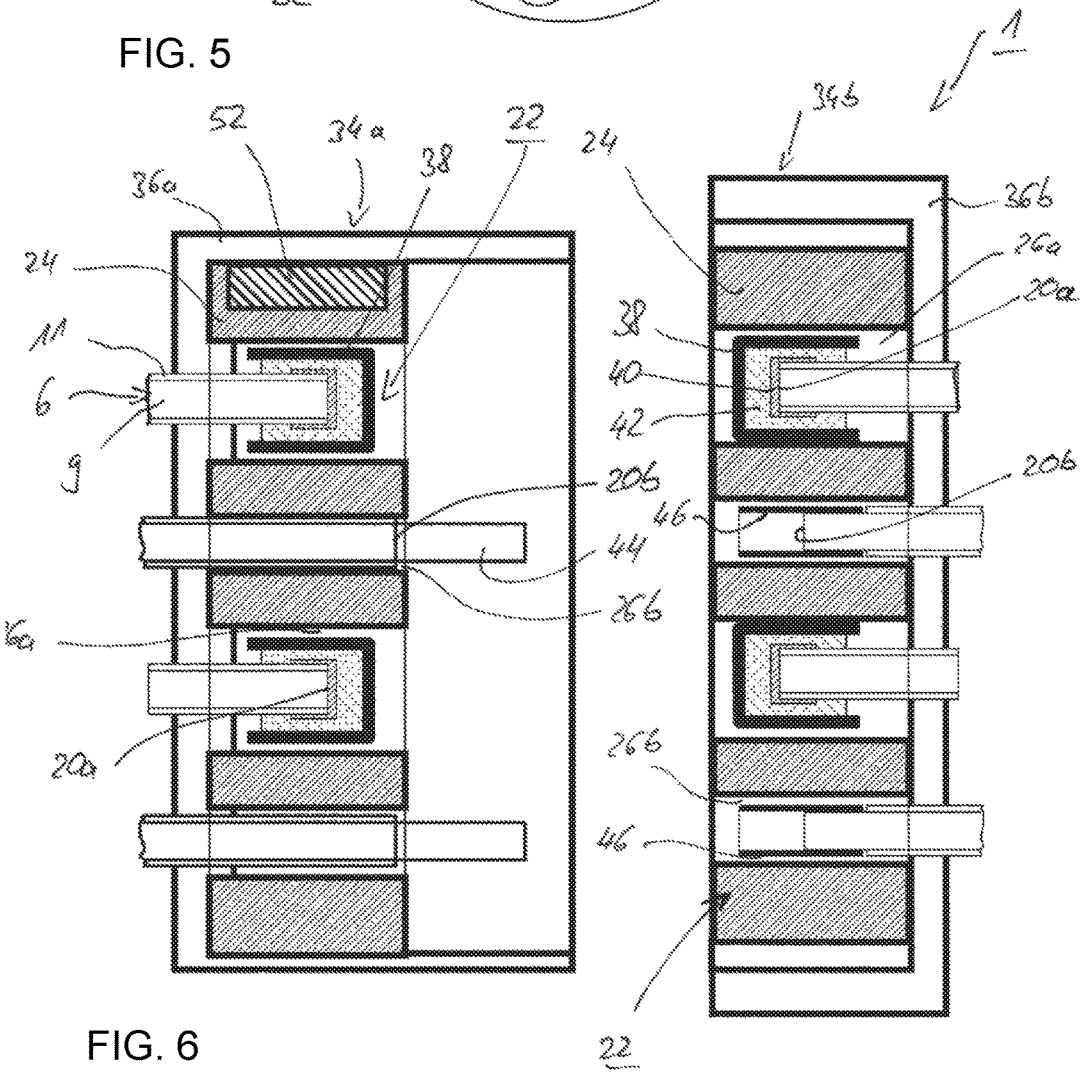
FIG. 6 is a schematic cross-sectional view of the coupling device having two coupling parts.

A special variant embodiment of the coupling device 3 is illustrated in FIG. 6. According to FIG. 6, the coupling device 3 has two coupling parts 34*a*, 34*b* which each receive a carrier 24 and comprise housing parts 36*a*, 36*b* which can be connected to one another to form the coupling and therefore hold the carrier 24 and therefore also the individual coupling ends 20*a*, 20*b* in a defined relative position in relation to one another. The housing parts 36*a*, 36*b* are configured, in a manner not illustrated in detail here, as plug parts or else as parts which can be screwed, for example, so that the two coupling parts 34*a*, 34*b* are therefore fastened to one another by screw-connection in the manner of screw couplings or, for example, by latching, and the carriers 24 are offset in relation to one another.

In order to form the insulating intermediate pieces 10, insulating sleeves 38, in particular ceramic sleeves into which the first coupling ends 20*a* are introduced, are formed in the exemplary embodiment. In the exemplary embodiment, a termination cap 40, in particular which is composed of metal, is fitted, for example by welding, onto the end side of a respective coupling end. In addition, the free space between the cap 40 and the sleeve 38 is filled with a further insulation material, in particular a silicone gel 42 or else an adhesive. This provides good insulation of the first coupling ends 20*a* in relation to one another and achieves a high degree of resistance to partial discharge. In contrast to this, plug connector elements are fitted in the case of the coupling ends 20*b* of the conductor sections 8, specifically a plug pin 44 on one side and a plug sleeve 46 on the other side. The plug connector elements serve to electrically conductively connect the second coupling ends 20*b*. The plug connector elements are electrically conductively connected, for example by welding or else by a crimping process, to the respective second coupling end 20*b*. The electrically conductive connection is automatically formed when the two coupling parts 34*a*, 34*b* are combined.

In the exemplary embodiment described in relation to FIG. 6, the intermediate piece 10 is configured in a manner divided into two in as much as two insulating sleeves 38 are each fitted to the first coupling ends 20*a*. There may further be an air gap between these sleeves 38 in the coupled state.

Figure 7:
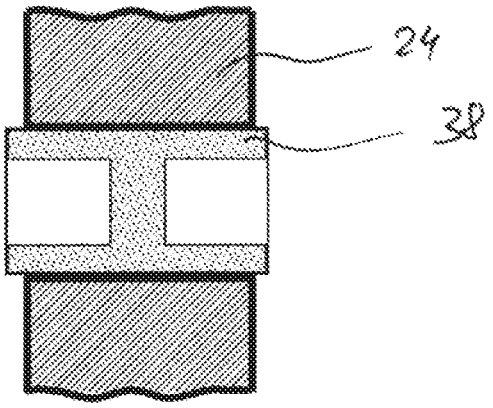
FIG. 7 is an illustration of a detail of a further exemplary embodiment of a coupling module.

FIG. 7 illustrates an alternative refinement of a sleeve 38, in which a double sleeve, in particular a ceramic sleeve, is situated in a respective first receptacle 26*a* of the carrier 22, it being possible for the coupling ends 20*a* to be plugged into said double sleeve from both sides.

Figure 8:
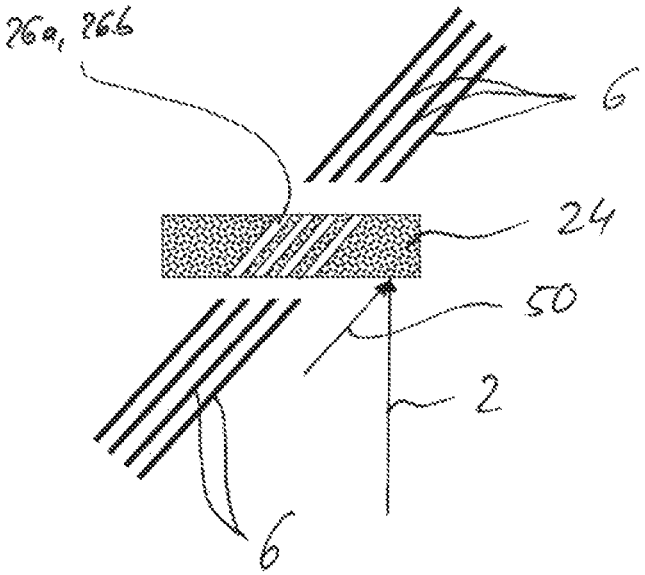
FIG. 8 is a highly simplified schematic illustration of receptacles, which are oriented in a connection direction, having conductor strands.

Finally, FIG. 8 shows a highly simplified illustration of another particular variant embodiment in which the receptacles 26*a*, 26*b* are oriented in a connection direction 50 at an angle in relation to the longitudinal direction 2. In this case, the angle corresponds, in particular, to a pitch angle of the individual cable cores 6 which the individual cable cores assume as a result of being braided with one another. This ensures that the cable cores 6 are in alignment with the connections 26*a*, 26*b*, so that a simple plug-in operation is possible.

Particularly in the case of this variant embodiment, it is possible to also use a flat cable to form the induction cable 1, in the case of the flat cable the individual conductor strands 9 each initially being arranged within a common plane in a common insulation sheath, and this ribbon cable then being wound around a central strand. Accordingly, it is also possible to provide a coupling device 3 for a ribbon cable of this kind which may be bent, the individual connections 26*a*, 26*b* being lined up next to one another in one row in the case of said coupling device.

Furthermore, a sensor module 52 is integrated into the coupling device 3, both the induction cable 1 itself and also the environment, that is to say characteristic data about the induction field for example, being monitored by the sensor module and corresponding measurement data being passed on to an evaluation unit, not illustrated in any detail here. Parameters to be monitored are, for example, the cable temperature, the ambient temperature or else seismic movements etc.

The following is a summary list of reference numerals and the corresponding structure used in the above description of the invention:

1 Induction cable
2 Cable longitudinal direction
3 Coupling device

4 Partial cable piece
6 Cable core
8 Conductor section
9 Conductor strand
10 Intermediate piece
11 Insulation
12 Component cable
14 Core bundle
15 Optical waveguide
16 Strain-relief means
18 Cable sheath
20*a, b* Coupling end
22 Coupling module
24 Carrier
26*a* First connections
26*b* Second connections
28 Recess
30 Functional connection
32 Cable end
34*a, b* Coupling part
36*a, b* Housing parts
38 Insulating sleeve
40 Cap
42 Silicone gel
44 Plug pin
46 Plug sleeve
50 Connection direction
52 Sensor module
a Contact spacing
R Resonance separation point
K Coupling position

The invention claimed is:

1. An induction cable, comprising:

a plurality of cable cores each having a conductor strand being surrounded by insulation and said conductor strand having a plurality of conductor sections which are respectively spaced apart at an insulating intermediate region by at least one insulating intermediate piece at resonance separation points in a cable longitudinal direction, said conductor strands having coupling ends at a coupling position;

a coupling device having two coupling parts and a coupling module having receptacles for said coupling ends of said conductor strands and disposed at the coupling position;

said coupling device is disposed at a resonance separation point, and said receptacles of said coupling module including a plurality of first receptacles for a first connection type and for accommodating first coupling ends of said coupling ends, wherein in each case said at least one insulating intermediate piece is situated in each of said first receptacles;

the induction cable further satisfying one of the following two conditions:

a) the induction cable is subdivided at the coupling position so as to form two cable ends, and said two coupling parts of said coupling device combining said cable ends, said receptacles of said coupling module include a plurality of second receptacles for a second connection type and for accommodating second coupling ends of said coupling ends, wherein two said coupling ends are electrically conductively connected to one another in each of said second receptacles; or b) only some of said conductor strands are connected by said coupling device and some of said conductor strands are continuous at the coupling position without interruption wherein said coupling module has a number of recesses formed therein for a passage of said conductor strands which are continuous at the coupling position.

2. The induction cable according to claim 1, wherein said coupling ends can be reversibly connected to one another by means of said coupling device.

3. The induction cable according to claim 1, wherein said coupling ends are held in said coupling device by means of plug connections and, to this end, plug connection elements are selectively formed at said coupling ends or in that said coupling ends are plugged into said receptacles of said coupling module.

4. The induction cable according to claim 1, further comprising sleeves disposed in said receptacles, said coupling ends being introduced into said sleeves and said sleeves are selectively formed from an insulating material or a conductive material.

5. The induction cable according to claim 4, wherein said sleeves each selectively have an at least partially profiled inner wall, or said coupling ends are provided with a profiled portion.

6. The induction cable according to claim 4, further comprising a termination piece fitted onto each of said coupling ends.

7. The induction cable according to claim 1, wherein said coupling module has a star-shaped carrier on which said receptacles are formed, wherein said star-shaped carrier having arms in which the first receptacles in a form of passage holes are formed and wherein said recesses, which are formed for the passage of said conductor strands which are continuous at the coupling position, are open radially and are formed between said arms.

8. The induction cable according to claim 1, wherein said coupling module is an injection-molded part.

9. The induction cable according to claim 1, further comprising a functional line selected from the group consisting of a strain-relief device, a sensor line and a data line, said functional line is guided through said coupling device without interruption or so as to form two partial pieces which are connected to one another.

10. The induction cable according to claim 1, wherein said coupling ends have a connection direction which is not parallel to the longitudinal direction but which is at a prespecified angle in relation to the longitudinal direction.

11. The induction cable according to claim 1, further comprising a sensor module integrated in said coupling device.

12. The induction cable according to claim 4, wherein said insulating material is a ceramic.

13. A method for producing an induction cable, which comprises the steps of:

connecting coupling ends of a plurality of cable cores to one another with an aid of a coupling device, the coupling device having two coupling parts and a coupling module with receptacles for coupling ends of a plurality of conductor strands of the cable cores and disposed at a coupling position, the coupling device is disposed at a resonance separation point, and the receptacles of the coupling module including a plurality of first receptacles for a first connection type and for accommodating first coupling ends of the coupling ends, the coupling device having in each case at least one insulating intermediate piece disposed in each of the first receptacles;

the induction cable further satisfying one of the following two conditions:

a) the induction cable is subdivided at the coupling position so as to form two cable ends, and the two coupling parts of the coupling device combining the cable ends, and the receptacles of the coupling module have a plurality of second receptacles for a second connection type and for accommodating second coupling ends of the coupling ends, wherein two of the coupling ends are electrically conductively connected to one another in each of the second receptacles; or b) only some of the conductor strands are connected by the coupling device and some of the conductor strands are continuous at the coupling position without interruption wherein the coupling module having a number of recesses formed therein for a passage of the conductor strands which are continuous at the coupling position.

14. The method according to claim 13, which further comprises:

connecting two cable ends to one another by means of the coupling device, in such a way that the cable ends are rotated relative to one another about a cable longitudinal direction, disposing sleeves disposed in the receptacles, the coupling ends being introduced into the sleeves and the sleeves are selectively formed from an insulating material or a conductive material;

introducing each of the first coupling ends into a sleeve;

fitting a plug connector element to each of the second coupling ends, namely a plug pin on one side and a plug sleeve on the other side;

fitting a termination cap onto the end side of a respective first coupling end and a free space between the termination cap and the sleeve is filled with a further insulation material.

15. The method according to claim 13, wherein conductor sections are provided as individual lengths and are connected by means of the coupling device so as to form resonance separation points.

16. The induction cable according to claim 4, wherein:

each of the first coupling ends is introduced into a sleeve being an insulating sleeve; and a plug connector element is fitted to each of the second coupling ends, namely a plug pin on one side and a plug sleeve on the other side.

17. The induction cable according to claim 16 wherein a termination cap is fitted onto said end side of the respective first coupling end and a free space between the termination cap and the sleeve is filled with a further insulation material.

18. The induction cable according to claim 10, wherein the conductor strands are running helically and having a pitch, wherein the connection direction of the receptacles corresponds to the pitch.

* * * * *